US011959353B2

(12) United States Patent
Gunasekaran et al.

(10) Patent No.: US 11,959,353 B2
(45) Date of Patent: Apr. 16, 2024

(54) MULTIPLE LAYERS OF OPEN-HOLE SEAL IN A WELLBORE

(71) Applicant: Halliburton Energy Services, Inc., Houston, TX (US)

(72) Inventors: Mohan Gunasekaran, Rio de Janeiro (BR); Jorge Gustavo Kuhnen, Biguaçu (BR); Laurence Campos Paiva Costa, Macae (BR); Desiderio Naegele Rodrigues, Jr., Macae (BR); Peterson Garcia Ramaldes, Vila Velha (BR)

(73) Assignee: Halliburton Energy Services, Inc., Houston, TX (US)

( * ) Notice: Subject to any disclaimer, the term of this patent is extended or adjusted under 35 U.S.C. 154(b) by 50 days.

(21) Appl. No.: 17/228,105

(22) Filed: Apr. 12, 2021

(65) Prior Publication Data

US 2022/0325599 A1 Oct. 13, 2022

(51) Int. Cl.
*E21B 33/12* (2006.01)
*E21B 23/06* (2006.01)

(52) U.S. Cl.
CPC ..... *E21B 33/1208* (2013.01); *E21B 23/06* (2013.01)

(58) Field of Classification Search
CPC ..... E21B 33/1208; E21B 33/12; E21B 23/06; E21B 33/1243; E21B 33/127; E21B 33/1216
See application file for complete search history.

(56) References Cited

U.S. PATENT DOCUMENTS 3,690,375 A * 9/1972 Shillander ..... E21B 33/1272 166/187
3,783,940 A * 1/1974 Urbanosky ..... E21B 33/134 166/187
4,424,861 A 1/1984 Carter, Jr. et al.
6,935,432 B2 * 8/2005 Nguyen ..... E21B 43/103 166/135
7,306,033 B2 12/2007 Gorrara
7,422,058 B2 9/2008 Omalley
7,866,387 B2 1/2011 Van Zuilekom et al.
9,163,474 B2 10/2015 Ramon
9,605,509 B2 * 3/2017 Doane ..... E21B 33/1208
(Continued)

FOREIGN PATENT DOCUMENTS

CN 109751010 5/2019
WO 2004065758 8/2004

OTHER PUBLICATIONS

Weatherford, "Cup-Seal Packers", www.weatherford.com/en/products-and/services/completions/openhole-isolation-packers/cup-seal-packers/, 2021, 4 pages.
(Continued)

*Primary Examiner* — Theodore N Yao
(74) *Attorney, Agent, or Firm* — Kilpatrick Townsend & Stockton LLP

(57) ABSTRACT

Multiple layers of a seal can be formed to pressure-seal an open-hole wellbore in a subterranean formation. The seal can include at least one element and a sealing mixture between the element and a container housing for pressure sealing the open-hole wellbore between the element and the container housing and for providing multiple layers of seal in the open-hole wellbore. The seal can be retained by the sealing mixture subsequent to the sealing mixture being released.

15 Claims, 4 Drawing Sheets

(56) References Cited

U.S. PATENT DOCUMENTS

| | | | | |
|---|---|---|---|---|
| 10,208,559 | B2 | 2/2019 | Takahashi et al. | |
| 2002/0166672 | A1* | 11/2002 | White | E21B 33/1212 166/387 |
| 2005/0155775 | A1* | 7/2005 | Hirth | E21B 33/128 166/387 |
| 2011/0042081 | A1* | 2/2011 | Streich | C09K 8/42 166/269 |
| 2012/0138315 | A1* | 6/2012 | Dewar | E21B 33/1208 166/387 |
| 2015/0308220 | A1* | 10/2015 | Hansen | E21B 33/13 166/285 |
| 2016/0348463 | A1* | 12/2016 | Vasques | E21B 33/127 |
| 2018/0087350 | A1* | 3/2018 | Sherman | E21B 43/086 |
| 2018/0119512 | A1* | 5/2018 | Murphree | E21B 33/1208 |
| 2019/0360297 | A1* | 11/2019 | Heiman | E21B 33/128 |
| 2020/0378210 | A1 | 12/2020 | Machocki | |

OTHER PUBLICATIONS

PCT Application No. PCT/US2021/027018 , International Search Report and Written Opinion, dated Jan. 3, 2022, 11 pages.

* cited by examiner

MULTIPLE LAYERS OF OPEN-HOLE SEAL IN A WELLBORE

TECHNICAL FIELD

The present disclosure relates generally to wellbore operations and, more particularly (although not necessarily exclusively), to sealing assemblies for open-hole wellbores.

BACKGROUND

A wellbore can be formed in a subterranean formation for producing hydrocarbon fluid from the formation. The subterranean formation can include a well-defined hydrocarbon reservoir. The wellbore may be an open-hole wellbore that may not include casing around a portion of the open-hole wellbore positioned proximate to the well-defined hydrocarbon reservoir. The open-hole wellbore may be used to extract produced hydrocarbons from the reservoir. Faster or otherwise more efficient extraction of the produced hydrocarbons can be achieved using techniques or wellbore-related tasks such as hydraulic fracturing. The wellbore-related tasks may involve sealing the open-hole wellbore, and, in some examples, the open-hole wellbore can be sealed using a packer. But, using a packer to seal the open-hole wellbore may not be sufficient for various techniques. The various techniques may include hydraulic fracturing in multiple locations off the open-hole wellbore, drilling or stimulating lateral wellbores adjacent to the open-hole wellbore, etc. In these cases, a packer that forms a seal in the open-hole wellbore may not be sufficient to allow the various techniques to be performed.

DETAILED DESCRIPTION

Figure 1:
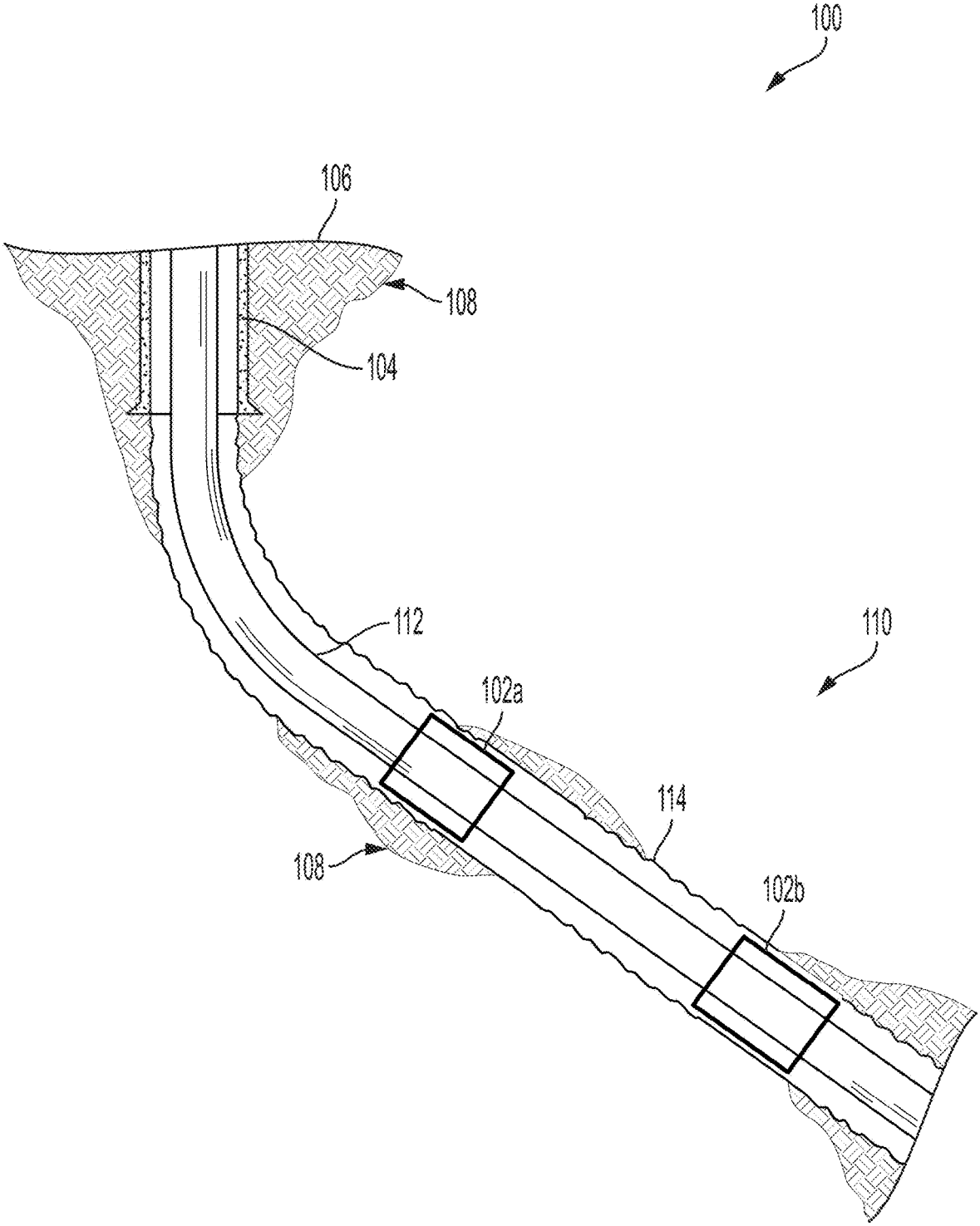
FIG. 1 is a diagram of an open-hole wellbore that includes at least one sealing assembly for pressure sealing the open-hole wellbore according to one example of the present disclosure.

Certain aspects and examples of the present disclosure relate to forming of seal using a multi-layer tool to pressure-seal an open-hole wellbore using a sealing assembly that includes at least two expandable sealing elements and a sealing mixture between the at least two expandable sealing elements. The sealing mixture may include cementitious material, resin-like material, a combination thereof, or other suitable components that include additives to modify properties for sealing the open-hole wellbore. The sealing mixture can be retained in a container housing before being released to seal the open-hole wellbore. The at least two expandable sealing elements may include rubber, an expandable polymeric material, or other suitable expandable material. The sealing assembly may be positioned downhole in the open-hole wellbore via a tubing or other deployment method, such as an electrical cable, a slickline, coiled tubing, etc., that includes a retaining mechanism for retaining the sealing assembly subsequent to the sealing assembly receiving differential pressure to form the multiple layers of seal. The sealing assembly may be expanded by receiving an applied differential pressure from the surface, by way of direct application, remote application, or other suitable method of pressure application. In response to receiving the applied differential pressure, the expanded sealing assembly may form the multiple layers of seal using the at least two sealing elements and the sealing mixture and may be retained via the retaining mechanism of the tubing. The multiple layers of seal may include a first pressure seal formed by the at least two expandable sealing elements and a second pressure seal formed by the sealing mixture.

In some examples, multiple layers of seal, that include at least the first pressure seal and the second pressure seal, can be formed downhole in the open-hole wellbore by the sealing assembly to retain the applied and received differential pressure. The sealing assembly can retain the multiple layers of seal by using the retaining mechanism of the tubing such that the multiple layers of seal are retained without constant, or otherwise additional, applied differential pressure. For example, the differential pressure may cause the sealing assembly to expand, and, in response to the sealing assembly expanding, the first pressure seal and the second pressure seal can be formed. Additionally or alternatively, in response to the sealing assembly expanding, the tubing can retain the expanded sealing assembly and prevent the sealing assembly from returning to an unexpanded state. In some examples, the sealing assembly can retain the multiple layers of seal using the sealing mixture in addition, or alternative, to using the retaining mechanism of the tubing. The sealing assembly may include at least two retainer rings with retaining teeth that, in response to the sealing assembly being expanded, contact the retaining mechanism of the tubing for retaining the expanded sealing assembly.

The sealing assembly may include rubber as the at least two sealing elements. Other suitable elements or material may be used in addition to, or as an alternative to, rubber. The sealing assembly may additionally include the container housing that includes the sealing mixture and a set of pistons for receiving the applied differential pressure. In response to applying the differential pressure, the pistons may actuate or otherwise displaced such that the sealing assembly expands. By expanding the sealing assembly, the pistons may cause the sealing mixture to be released to fill a void in the expanded sealing assembly and to form the second pressure seal. The void in the sealing assembly may be formed by expanding the sealing energy. In some examples, a set of internal seals can provide seals within the sealing assembly to prevent the sealing mixture from leaking out of the sealing assembly and to allow the sealing mixture to form the second pressure seal.

Additionally or alternatively, expanding the sealing assembly may energize the expandable sealing elements for forming the first pressure seal. The sealing assembly may additionally include a rigid containing mechanism that can be positioned adjacent to the expandable sealing elements opposite the container housing. In some examples, in response to the pistons actuating and the sealing assembly expanding, the rigid containing mechanism may retain the expandable sealing elements and may allow the expandable sealing elements to expand to contact a wall of the open-hole wellbore to form the first pressure seal.

The sealing assembly can be positioned downhole in the open-hole wellbore with the tubing, and, upon the sealing assembly reaching a desired or otherwise planned depth, the differential pressure can be applied to the sealing assembly. The differential pressure can be applied using, or through, the tubing, and the pistons can receive the applied differential pressure. The received differential pressure can cause the pistons to be displaced or to be otherwise actuated. The pistons may subsequently cause the sealing assembly to expand and may subsequently cause the sealing mixture to be released from the container housing to fill the void and to energize the expandable sealing elements to contact a wall of the open-hole wellbore for forming the first pressure seal. In some examples, the expandable sealing element can include rubber. The rubber can include a cup-packer type rubber, a cone rubber, or a wedge rubber, and can be used to grip the rubber at both ends of the sealing assembly while the sealing mixture is released to form the second pressure seal, thereby forming the multiple layers of seal to hold the applied differential pressure.

In some examples, the sealing assembly can include a primary sealing element and a secondary sealing element. The expandable sealing elements can be the primary sealing element, and the sealing mixture can be the secondary sealing element. In these examples, a packer that includes the sealing assembly can be expanded downhole via the applied differential pressure as a trigger. For example, in response to triggering expansion using the applied differential pressure, the primary sealing element can form the first pressure seal, and then the secondary sealing element can form the second pressure seal. Using the primary sealing element and the secondary sealing element can cause the multiple layers of seal to be formed in a timely manner compared to other open hole packing methods.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a diagram of an open-hole wellbore 100 that includes at least one sealing assembly 102 for pressure sealing the open-hole wellbore 100 according to one example of the present disclosure. As illustrated, the open-hole wellbore 100 includes two sealing assemblies 102*a-b*, but any suitable number of sealing assemblies 102 can be used to form multiple layers of seal. The sealing assemblies 102 may be positioned downhole in the open-hole wellbore 100 for defining zones of the open-hole wellbore 100. The zones may be pressure-isolated zones that are not affected by pressures or pressure changes from other portions of the open-hole wellbore 100. The open-hole wellbore 100 may include a casing 104 at the surface 106. The casing 104 may extend from the surface 106 to a point in the open-hole wellbore 100 that is between the surface 106 and the bottom or end of the open-hole wellbore 100. The open-hole wellbore 100 may be formed in a subterranean formation 108 that can include hydrocarbon material such as oil, gas, or other suitable hydrocarbon material. The subterranean formation 108 may include a hydrocarbon reservoir that can include the hydrocarbon material. In some examples, the hydrocarbon reservoir can be well-defined, which may allow formation of the open-hole wellbore 100. In other examples, the open-hole wellbore 100 can extract produced hydrocarbons from the hydrocarbon reservoir via wellbore-related tasks such as hydraulic fracturing. The sealing assemblies 102 may each form the multiple seals to pressure-seal the open-hole wellbore 100 for performing operations, such as hydraulic fracturing, involving the subterranean formation 108. A portion 110 of the open-hole wellbore 100 may be pressure-sealed or otherwise isolated from other portions of the open-hole wellbore 100 by the sealing assemblies 102 for performing the operations.

The sealing assemblies 102 may be positioned in the open-hole wellbore 100 using a tubing 112 that includes a retaining mechanism. The tubing 112 can extend up to the surface 106. In some examples, the tubing 112 can be divided into a set of segments in which one or more segment of the segments can be installed in a subsequent operation. Additionally or alternatively, a lower portion of the tubing 112 can be deployed using electrical cable line, such as wireline, slickline, or coiled tubing. Once positioned at a desired location, or otherwise planned depth, the sealing assemblies 102 may receive an applied differential pressure from the surface 106. The differential pressure can be directly applied, remotely applied, or applied in other suitable methods for applying pressure in the open-hole wellbore 100. Alternatively, other methods of applying the differential pressure can be used such as electro-mechanical actuation or other mechanical arrangements activated by tubing manipulation. In response to receiving the applied differential pressure, the sealing assemblies 102 may expand and may form the multiple layers of seal in the open-hole wellbore 100. In some examples, in response to the sealing assemblies 102 receiving the differential pressure, the portion 110 of the open-hole wellbore 100 may be pressure-sealed for performing wellbore operations involving the subterranean formation 108.

In response to the sealing assemblies 102 receiving the applied differential pressure, a first pressure-seal can be formed by sealing elements within the sealing assemblies 102, and a second pressure-seal can be formed by a sealing mixture. By expanding, the sealing assemblies 102 may cause the sealing elements to energize and to expand to contact a wall 114 of the open-hole wellbore 100 for forming the first pressure-seal. Additionally or alternatively, by expanding, the sealing assemblies 102 may cause the sealing mixture to be released into one or more voids generated by expanding the sealing assemblies 102. The sealing mixture may fill the voids and may contact the wall 114 of the open-hole wellbore 100 for forming the second pressure-seal. In some examples, once released, the sealing mixture may harden or otherwise form a bond with the wall 114 of the open-hole wellbore 100 for forming the second pressure seal.

Figure 2:
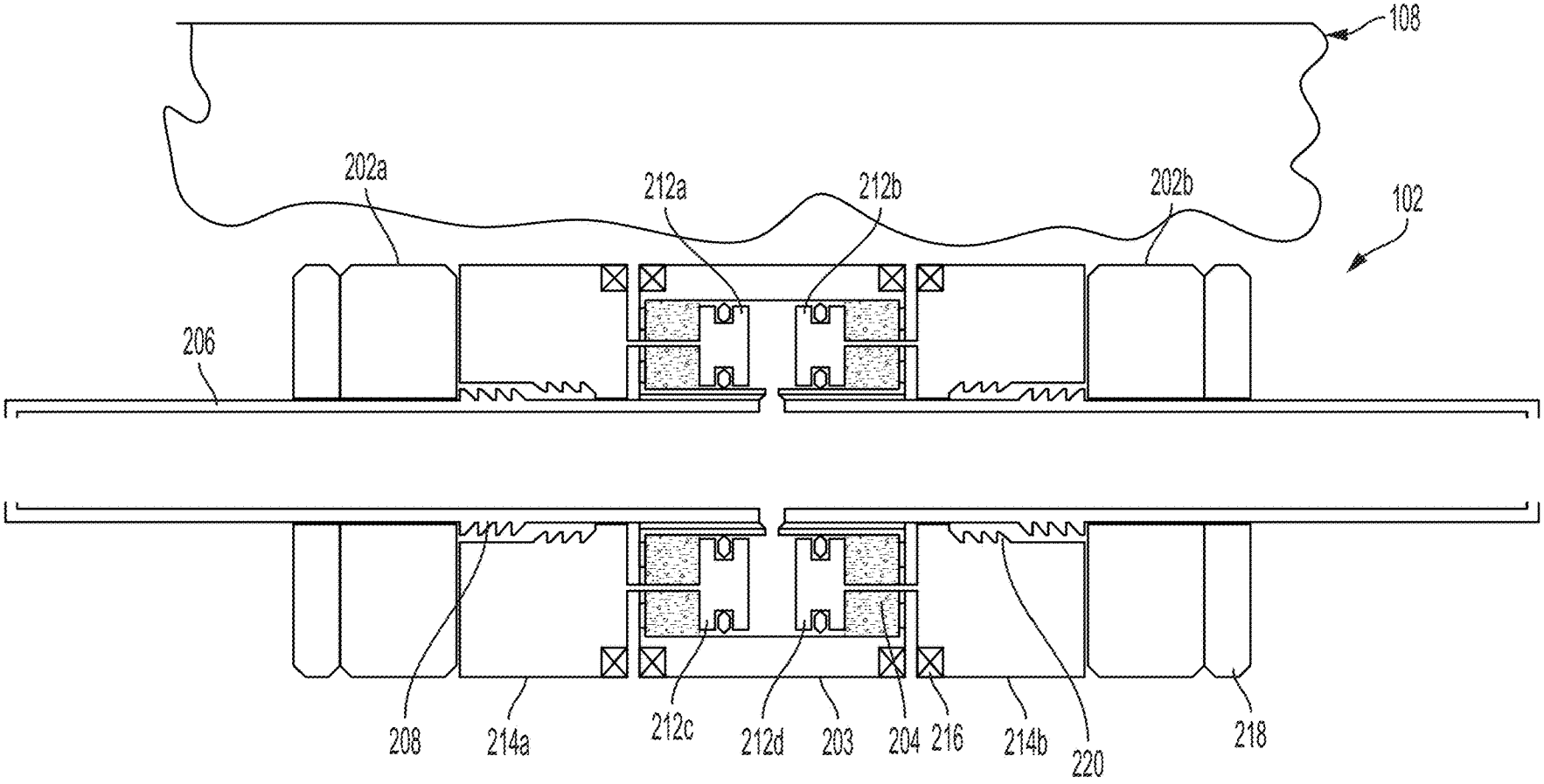
FIG. 2 is a cross-sectional side-view of a sealing assembly for pressure sealing an open-hole wellbore according to one example of the present disclosure.
Figure 3:
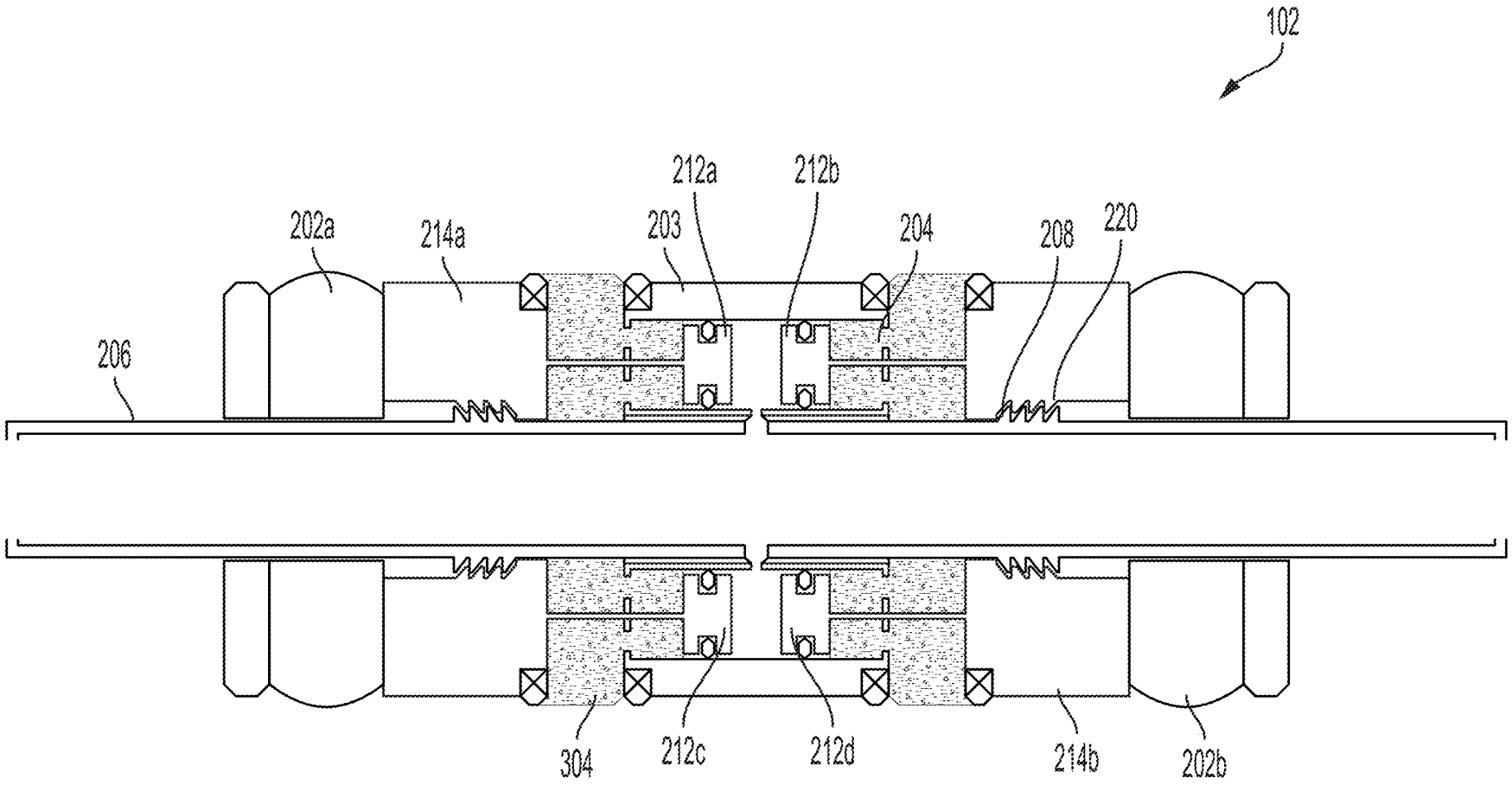
FIG. 3 is a cross-sectional side view of an expanded sealing assembly according to one example of the present disclosure.

FIG. 2 is a cross-sectional side-view of a sealing assembly 102 for forming the multiple layers of seal to pressure seal an open-hole wellbore 100, and FIG. 3 is a cross-sectional side view of an expanded sealing assembly 102 according to one example of the present disclosure. The sealing assembly 102 may be positioned, or otherwise disposed, downhole in the open-hole wellbore 100. In some examples, the sealing assembly 102 may be positioned in the open-hole wellbore 100 such that the sealing assembly 102 is adjacent to the subterranean formation 108. The sealing assembly 102 may include at least two expandable sealing elements 202*a-b* and a container housing 203 that can include a sealing mixture 204 and that can be positioned between the at least two expandable sealing elements 202. The sealing assembly 102 can pressure-seal the open-hole wellbore 100 between the at least two expandable sealing elements 202 using the sealing mixture 204. The sealing mixture 204 may additionally or alternatively be positioned for providing the multiple layers of seal that can be retained by a tubing 206 that includes a retaining mechanism 208. In some examples, the multiple layers of seal can be retained by the sealing mixture 204. The sealing assembly 102 may be positioned around, and may be positioned downhole in the open-hole wellbore 100 via, the tubing 206. Once positioned downhole, the sealing assembly 102 may receive differential pressure to form multiple layers of seal in the open-hole wellbore 100.

The differential pressure may be applied to the sealing assembly 102 directly from the surface of the open-hole wellbore 100 or in other, suitable, remote pressure-application methods. The differential pressure may be applied to the sealing assembly 200 via the tubing 206, and the differential pressure may be received by the sealing assembly 102 via a plurality of pistons 212*a-d*. As illustrated, the plurality of pistons 212 includes four pistons 212*a-d*, but other suitable amounts of pistons 212 can be included in the sealing assembly 102 for forming the multiple layers of seal in the open-hole wellbore 100. The pistons 212 can be positioned within the container housing 203 for receiving the applied differential pressure to expand the sealing assembly 102. The applied differential pressure may cause the sealing assembly 102 to expand, as illustrated in FIG. 3, and to form multiple layers of seal within the open-hole wellbore 100.

The sealing assembly 102 may additionally include at least two retainer rings 214*a-b*, a set of internal seals 216, and a rigid containing mechanism 218. As illustrated, the sealing assembly 102 includes two retainer rings 214*a-b*, but other suitable amounts of retainer rings 214 can be included in the sealing assembly 102. The pistons 212 may be mechanically coupled to the retainer rings 214. The pistons 212 may actuate, and, in response to receiving the pressure, the actuated pistons 212 may cause the sealing mixture 204 to be released into the expanded sealing assembly 102. For example, the pistons 212 can receive the applied differential pressure, can actuate, and can apply an outward force on the retainer rings 214. The outward force may cause the retainer rings 214 to displace outward, which may allow the sealing mixture 204 to be released from the container housing 203 and may allow the multiple layers of seal to be formed. Additionally or alternatively, the actuated pistons 212 may cause the retainer rings 214 to be displaced outward to energize the expandable sealing elements 202 and to cause the expandable sealing elements 202 to expand. The actuated pistons 212 may additionally cause retaining teeth 220 of the retainer rings 214 to contact the retaining mechanism 208 of the tubing 206. The expanded sealing assembly 102, and the applied differential pressure, may be retained subsequent to the retaining teeth 220 contacting the retaining mechanism 208. For example, in response to the retaining teeth 220 contacting the retaining mechanism 208, the applied differential pressure can be removed, and the expanded sealing assembly 102 may not return to an unexpanded state.

The internal seals 216 may be positioned adjacent the retainer rings 214 and the container housing 203 and may provide internal seals within the sealing assembly 102 to prevent the sealing mixture 204 from leaking out of the sealing assembly 102 subsequent to the sealing assembly 102 expanding. For example, in response to the sealing mixture 204 being released from the container housing 203, the sealing mixture 204 may fill a void 304 in the expanded sealing assembly 102, but the internal seals 216 may retain the sealing mixture 204 within the void 304 of the expanded sealing assembly 102. The rigid containing mechanism 218 may be positioned adjacent to the at least two expandable sealing elements 202, opposite the retainer rings 214, and may contain the at least two expandable sealing elements 202 subsequent to the sealing assembly 102 receiving the differential pressure and expanding. In some examples, the rigid containing mechanism 218 may allow the sealing elements 202 to be energized in response to the sealing assembly 102 receiving the differential pressure. The rigid containing mechanism 218 may allow the sealing elements 202 to expand to contact the wall 114 of the open-hole wellbore 100 for forming the first pressure-seal.

The at least two expandable sealing elements 202 may expand radially and may contact the wall 114 of the open-hole wellbore 100 in response to the sealing assembly 102 receiving the differential pressure and expanding. By contacting the wall 114 of the open-hole wellbore 100, the at least two expandable sealing elements 202 may form the first pressure-seal in the open-hole wellbore 100. In some examples, the first pressure-seal may include more than one seal. For instance, in an example in which there are two expandable sealing elements 202, the two expandable sealing elements 202 may form two of the first pressure-seals. Additionally, in response to the sealing mixture 204 being released from the container housing 203 into the expanded sealing assembly 102 by the actuated pistons 212, the sealing mixture 204 may contact the wall 114 of the open-hole wellbore 100. The sealing mixture 204 may fill the void 304 that is formed by the expanded sealing assembly 102 in response to the sealing assembly 102 receiving the differential pressure. By filling the void 304 and contacting the wall 114 of the open-hole wellbore 100, the sealing mixture 204 may form a second pressure-seal in the open-hole wellbore 100.

In some examples, the expanded sealing assembly 102 may form multiple layers of seal. For instance, the expanded sealing assembly 102 can form the first pressure-seal and the second pressure-seal using the expandable sealing elements 202 and the sealing mixture 204, respectively. In one example in which the expanded sealing assembly 102 includes two expandable sealing elements 202, the expanded sealing assembly 102 includes three pressure seals: two of the first pressure-seals from the two expandable sealing elements 202 and one of the second pressure-seal from the sealing mixture 204. In this example, the three pressure seals may provide three layers of seal in the open-hole wellbore 100, and the three pressure seals may cause at least two pressure-isolated regions to be formed between the second pressure-seal and each first pressure-seal. Other suitable amounts of expandable sealing elements 202 for forming other suitable amounts of first-pressure seals can be included in the sealing assembly 102.

In some examples, more than one sealing assembly 102 can be positioned downhole in the open-hole wellbore 100. Any suitable number of sealing assemblies 102 can be positioned in the open-hole wellbore 100 for forming multiple layers of seal to pressure-seal the open-hole wellbore 100 for performing wellbore-related tasks. The tubing 206 can be used to position each sealing assembly 102 in the open-hole wellbore 100. In some examples, the tubing 206 may include an amount of retaining mechanisms approximately equal to twice the amount of sealing assemblies 102 that are positioned in the open-hole wellbore 100. The sealing assemblies 102 may receive differential pressure that is applied directly, remotely, or otherwise, via the tubing 206. In some examples, each sealing assembly 102 that is positioned in the open-hole wellbore 100 may include at least two expandable sealing elements 202, the sealing mixture 204, the container housing 203, the pistons 212, the at least two retainer rings 214, the internal seals 216, the rigid containing mechanism 218, the retaining teeth 220 of the retainer rings 214. Additional or alternative components can be included in each sealing assembly to form multiple seals in the open-hole wellbore 100.

In some examples, in response to receiving the applied differential pressure, the sealing assemblies 102 may form multiple layers of seal that can form pressure-isolated regions in the open-hole wellbore 100. The pressure-isolated regions may be portions of the open-hole wellbore 100 that are not affected by pressures or pressure changes in other portions of the open-hole wellbore 100. In an example in which three sealing assemblies 102 are positioned in the open-hole wellbore 100, the sealing assemblies 102 can receive the differential pressure and expand. Once expanded, the sealing assemblies may each form multiple layers of seal that form the pressure-isolated regions. In the example in which three sealing assemblies 102 are positioned in the open-hole wellbore 100, at least two pressure-isolated regions can be formed in which the pressure-isolated regions can be positioned between any two expanded sealing assemblies 102. While the example discusses at least two pressure-isolated regions, any suitable amount of pressure-isolated regions can be included in the open-hole wellbore 100 for performing wellbore-related operations such as hydraulic fracturing.

While FIG. 2 illustrates the sealing assembly 102 including two expandable sealing elements 202*a-b*, the sealing assembly 102 can alternatively include at least one element and a container housing 203 that includes the sealing mixture 204. For example, the element can be positioned adjacent to one retainer ring 214, and the retainer ring 214 can be positioned adjacent to the container housing 203. In this example, the sealing mixture 204 may be retained within the container housing 203 prior to the sealing assembly 102 receiving the differential pressure. The differential pressure can be applied to the sealing assembly 102 to expand the sealing assembly 102, and the sealing mixture 204 can be released from the container housing 203. In some examples, the sealing mixture 204 may be retained in the void 304 created by the expanded sealing assembly 102 via gravity or other related force. Subsequent to the sealing mixture 204 being released from the container housing 203 into the void 304, the sealing mixture 204 can form a pressure seal in the open-hole wellbore 100. Additionally or alternatively, the element can be an expandable sealing element that, in response to the differential pressure being received by the sealing assembly 102, can expand to contact the wall 114 of the open-hole wellbore 100 to form an additional pressure seal in the open-hole wellbore 100. The combination of the pressure seal from the sealing mixture 204 and the additional pressure seal from the element can yield multiple layers of seal in the open-hole wellbore 100.

Figure 4:
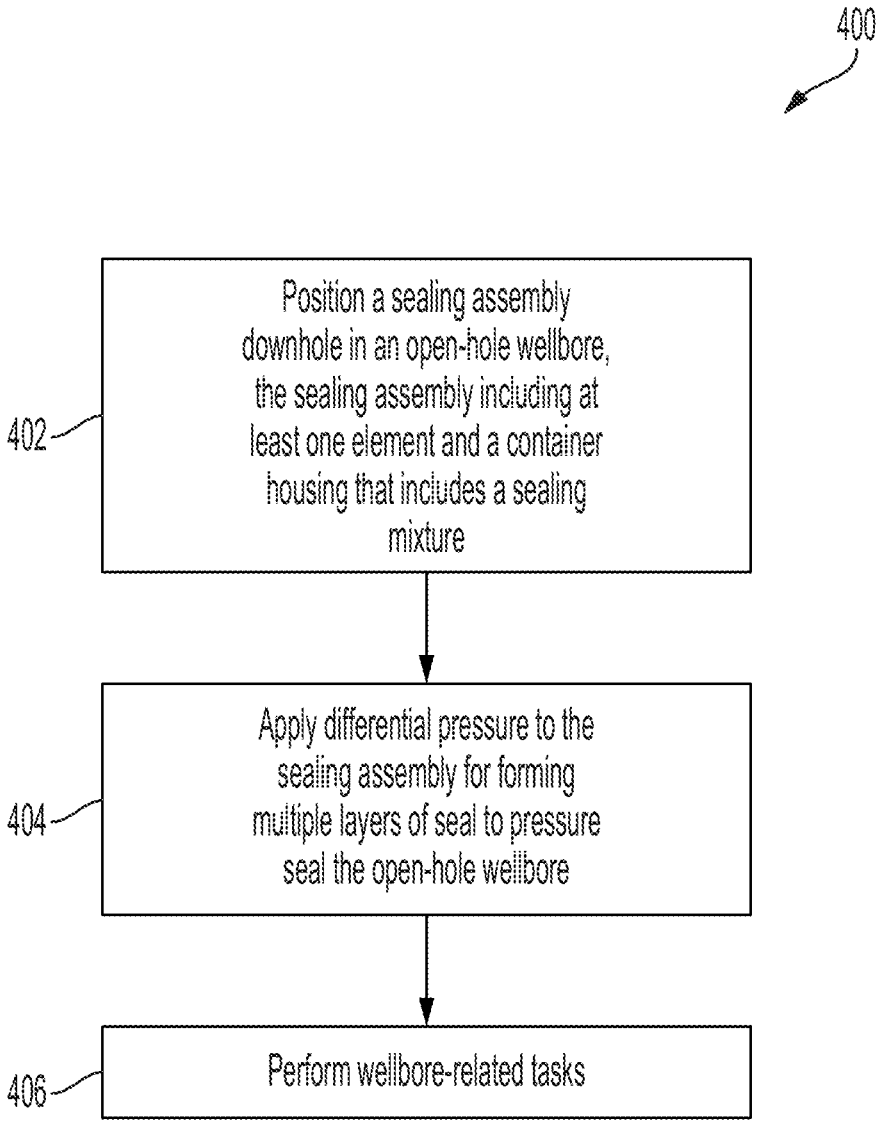
FIG. 4 is a flow chart of a process for applying differential pressure to a sealing assembly according to one example of the present disclosure.

FIG. 4 is a flow chart of a process 400 for applying differential pressure to a sealing assembly 200, which includes at least one element and a container housing 203 that includes a sealing mixture 204, to pressure-seal an open-hole wellbore 100 for forming multiple layers of seal in the open-hole wellbore 100 according to one example of the present disclosure. At block 402, the sealing assembly 200 is positioned downhole in the open-hole wellbore 100. The at least one element may include an expandable elastomeric material such as rubber, an expandable polymer, or other suitable expandable elastomeric material. The expandable elastomeric material may be characterized by an expansion ratio of between 3% to 50% of an outside diameter of the sealing assembly 102. In some examples, the expansion ratio of the expandable elastomeric material can depend on properties of the expandable elastomeric material, an outer diameter of the sealing assembly 102, an inner diameter of the open-hole wellbore 100, a combination thereof, or other suitable factors. The sealing mixture 204 may include cement, resin, a combination thereof, or other suitable material for sealing the open-hole wellbore 100. The sealing mixture 204 may be retained in the container housing 203 before being released. In some examples, the sealing assembly may include the at least two expandable sealing elements 202. The sealing assembly 200 may be positioned downhole in the open-hole wellbore 100 using the tubing 206 that includes the retaining mechanism 208. The sealing assembly 200 may additionally include the pistons 212 and the at least two retainer rings 214 that include the retaining teeth 220. The expandable sealing elements 202 may be retained, or otherwise held in place relative to the sealing assembly 200, by the rigid containing mechanism 218.

At block 404, the sealing assembly 200 receives differential pressure to form the multiple layers of seal to pressure-seal the open-hole wellbore 100. The differential pressure may be applied from the surface 106 directly, by using a remote applicator, or by other suitable methods of applying pressure in the open-hole wellbore 100. The differential pressure may be applied to, and may be received by, the sealing assembly 200 via the pistons 212. In response to receiving the differential pressure, the sealing assembly 200 may expand into the expanded sealing assembly 300 such that the at least two expandable sealing elements 202 are energized to expand and contact the wall 114 of the open-hole wellbore 100 and the sealing mixture 204 is released from the container housing 203. The expanded sealing assembly 300 may be retained by the retaining mechanism 208 of the tubing 206 in which the retaining teeth 220 contact the retaining mechanism 208 for retaining the applied differential pressure.

By contacting the wall 114 of the open-hole wellbore 100, the at least two sealing elements 202 may form the first pressure-seal, and, by being released from the container housing 203, the sealing mixture 204 may form the second pressure-seal. The first pressure-seal and the second pressure-seal may include suitable amounts of seals for forming the multiple layers of seal in the open-hole wellbore 100. The first pressure-seal and the second pressure-seal may, in combination, provide the multiple layers of seal in the open-hole wellbore 100 for pressure-sealing the open-hole wellbore 100.

At block 406, the expanded sealing assembly 300 retains the multiple layers of seal in the open-hole wellbore 100 for performing wellbore-related tasks. The wellbore-related tasks may include hydraulic fracturing or other suitable wellbore-related tasks that typically use pressure seals. The expanded sealing assembly 300 may retain the multiple layers of seal, without additional or constant applied differential pressure, by causing the retaining teeth 220 of the retainer rings 214 to contact the retaining mechanism 208 of the tubing 206 as described with respect to the block 404 of the process 400.

In some aspects, sealing assemblies, methods, and systems for forming multiple layers of seal to pressure seal an open-hole wellbore with a sealing assembly that includes at least two expandable sealing elements and a sealing mixture are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a sealing assembly for an open-hole wellbore, the sealing assembly comprising: at least one element; and a container housing positionable within the sealing assembly for retaining a sealing mixture that is releasable from the container housing for pressure sealing the open-hole wellbore between the at least one element and the container housing and for providing multiple layers of seal.

Example 2 is the sealing assembly of example 1, wherein the at least one element is a first expandable sealing element, the sealing assembly further comprising a second expandable sealing element, wherein the container housing is positionable between the first expandable sealing element and the second expandable sealing element for retaining the sealing mixture that is releasable from the container housing for pressure sealing the open-hole wellbore between the first expandable sealing element and the second expandable sealing element.

Example 3 is the sealing assembly of examples 1-2, further comprising: at least two retainer rings adjacent to the first expandable sealing element and the second expandable sealing element, the at least two retainer rings comprising retaining teeth positioned on an interior surface of the at least two retainer rings adjacent to a tubing, wherein the tubing comprises a retaining mechanism, and wherein the sealing assembly is positionable around the tubing for being positioned downhole in the open-hole wellbore; a plurality of pistons mechanically coupled to the at least two retainer rings; at least two internal seals adjacent to the at least two retainer rings and to the container housing; and a rigid containing mechanism positioned adjacent to the first expandable sealing element and the second expandable sealing element opposite the at least two retainer rings.

Example 4 is the sealing assembly of examples 1-3, wherein differential pressure is receivable by the plurality of pistons to form the multiple layers of seal, and wherein the plurality of pistons, in response to receiving the differential pressure, cause the sealing assembly to expand such that the retaining teeth of the at least two retainer rings contact the retaining mechanism of the tubing to retain the expanded sealing assembly.

Example 5 is the sealing assembly of examples 1-4, wherein: the sealing mixture is positionable within the container housing for retaining the sealing mixture before the sealing assembly is expanded; the multiple layers of seal include a first pressure seal formed by the first expandable sealing element and the second expandable sealing element and a second pressure seal formed by the sealing mixture; the multiple layers of seal are formable in response to the plurality of pistons receiving the differential pressure and the sealing assembly expanding; the rigid containing mechanism, in response to the plurality of pistons receiving the differential pressure, contains the first expandable sealing element and the second expandable sealing element and allows the first expandable sealing element and the second expandable sealing element to expand to contact a wall of the open-hole wellbore to form the first pressure seal; and the at least two internal seals provide seals within the sealing assembly to prevent the sealing mixture from leaking, and to allow the sealing mixture to form the second pressure seal, after the sealing assembly is expanded.

Example 6 is the sealing assembly of example 1, wherein the at least one element includes an expandable elastomeric material, and wherein the expandable elastomeric material is characterized by an expansion ratio of between 3% to 50% of an outside diameter of the sealing assembly.

Example 7 is the sealing assembly of example 1, wherein the sealing assembly is a first sealing assembly, wherein the first sealing assembly is included in a plurality of sealing assemblies, each sealing assembly in the plurality of sealing assemblies being similar or identical to the first sealing assembly, and wherein the plurality of sealing assemblies are positionable downhole in the open-hole wellbore to form the multiple layers of seal in a plurality of sections of the open-hole wellbore.

Example 8 is a method comprising: positioning a sealing assembly downhole in an open-hole wellbore, the sealing assembly comprising at least one element and a container housing that includes a sealing mixture; applying differential pressure to the sealing assembly to form multiple layers of seal between the at least one element and the container housing to pressure seal the open-hole wellbore; and performing wellbore-related tasks in the pressure-sealed open-hole wellbore.

Example 9 is the method of example 8, wherein the sealing assembly is a first sealing assembly, wherein the first sealing assembly is included in a plurality of sealing assemblies, each sealing assembly in the plurality of sealing assemblies being similar or identical to the first sealing assembly, and wherein the plurality of sealing assemblies are positioned downhole in the open-hole wellbore to form the multiple layers of seal in a plurality of sections of the open-hole wellbore.

Example 10 is the method of example 8, wherein the at least one element includes an expandable elastomeric material, and wherein the expandable elastomeric material is characterized by an expansion ratio of between 3% and 50% of an outside diameter of the sealing assembly.

Example 11 is the method of example 8, wherein the at least one element is a first expandable sealing element, and wherein the sealing assembly further comprises: a second expandable sealing element, wherein the container housing is positionable between the first expandable sealing element and the second expandable sealing element for retaining the sealing mixture that is releasable from the container housing for pressure sealing the open-hole wellbore between the first expandable sealing element and the second expandable sealing element; at least two retainer rings adjacent to the first expandable sealing element and the second expandable sealing element, the at least two retainer rings comprising retaining teeth positioned on an interior surface of the at least two retainer rings adjacent to a tubing, wherein the tubing comprises a retaining mechanism, and wherein the sealing assembly is positionable around the tubing for being positioned downhole in the open-hole wellbore; a plurality of pistons mechanically coupled to the at least two retainer rings; at least two internal seals adjacent to the at least two retainer rings and to the container housing; and a rigid containing mechanism positioned adjacent to the first expandable sealing element and the second expandable sealing element opposite the at least two retainer rings.

Example 12 is the method of examples 8 and 11, wherein applying the differential pressure to the sealing assembly includes applying the differential pressure to the plurality of pistons to expand the sealing assembly such that the retaining teeth of the at least two retainer rings contact the retaining mechanism of the tubing to retain the expanded sealing assembly.

Example 13 is the method of examples 8 and 11, wherein applying differential pressure to the sealing assembly to form multiple layers of seal to pressure seal the open-hole wellbore includes: forming a first pressure seal by causing the first expandable sealing element or the second expandable sealing element to expand to contact a wall of the open-hole wellbore; and forming a second pressure seal by causing the sealing mixture to be released from the container housing to contact the wall of the open-hole wellbore, wherein: the differential pressure is received by the plurality of pistons to cause the first expandable sealing element or the second expandable sealing element to expand and to cause the sealing mixture to be released; the multiple layers of seal include the first pressure seal and the second pressure seal; and the at least two internal seals provide seals within the sealing assembly to prevent the sealing mixture from leaking, and to allow the sealing mixture to form the second pressure seal, after the plurality of pistons receive the applied differential pressure.

Example 14 is the method of examples 8, 11, and 13 wherein: the sealing mixture is positioned within the container housing for retaining the sealing mixture before the differential pressure is received by the plurality of pistons; and the rigid containing mechanism, in response to the plurality of pistons receiving the applied differential pressure, contains the first expandable sealing element and the second expandable sealing element and allows the first expandable sealing element and the second expandable sealing element to expand to contact a wall of the open-hole wellbore to form the first pressure seal.

Example 15 is a system for forming multiple layers of seal in an open-hole wellbore, the system comprising: at least one element; a container housing positionable within the system for retaining a sealing mixture that is releasable from the container housing for pressure sealing the open-hole wellbore between the at least one element and the container housing and for providing multiple layers of seal; and a tubing comprising a retaining mechanism for retaining the system after the system expands.

Example 16 is the system of example 15, wherein the at least one element in a first expandable sealing element, the system further comprising a second expandable sealing element, wherein the container housing is positionable between the first expandable sealing element and the second expandable sealing element for retaining the sealing mixture that is releasable from the container housing for pressure sealing the open-hole wellbore between the first expandable sealing element and the second expandable sealing element.

Example 17 is the system of examples 15-16, further comprising: at least two retainer rings adjacent to the first expandable sealing element and the second expandable sealing element, the at least two retainer rings comprising retaining teeth positioned on an interior surface of the at least two retainer rings adjacent to the tubing; a plurality of pistons mechanically coupled to the at least two retainer rings; at least two internal seals adjacent to the at least two retainer rings and to the container housing; and a rigid containing mechanism positioned adjacent to the first expandable sealing element and the second expandable sealing element opposite the at least two retainer rings.

Example 18 is the system of examples 15-17, wherein differential pressure is receivable by the plurality of pistons to form the multiple layers of seal, and wherein the plurality of pistons, in response to receiving the differential pressure, cause the system to expand such that the retaining teeth of the at least two retainer rings contact the retaining mechanism of the tool to retain the expanded system.

Example 19 is the system of examples 15-18, wherein: the sealing mixture is positionable within the container housing before the system is expanded; the multiple layers of seal include a first pressure seal formed by the first expandable sealing element and the second expandable sealing element and a second pressure seal formed by the sealing mixture; the rigid containing mechanism, in response to the plurality of pistons receiving the differential pressure, contains the first expandable sealing element and the second expandable sealing element and allows the first expandable sealing element and the second expandable sealing element to expand to contact a wall of the open-hole wellbore to form the first pressure seal; the at least two internal seals provide seals within the system to prevent the sealing mixture from leaking, and to allow the sealing mixture to form the second pressure seal, after the system is expanded; and the multiple layers of seal are formable in response to the plurality of pistons receiving the differential pressure and the system expanding.

Example 20 is the system of example 15, wherein the at least one element includes an expandable elastomeric material, and wherein the expandable elastomeric material is characterized by an expansion ratio of between 3% and 50% of an outside diameter of the system.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A sealing assembly for an open-hole wellbore, the sealing assembly comprising:

at least one element comprising a first expandable sealing element and a second expandable sealing element;

a sealing mixture; and a container housing positionable between the first expandable sealing element and the second expandable sealing element for retaining the sealing mixture that is releasable, in response to the sealing assembly being actuated, from the container housing (i) to directly contact a wall of the open-hole wellbore for pressure sealing the open-hole wellbore between the at least one element and the container housing and (ii) for providing multiple layers of seal, wherein differential pressure is receivable by a plurality of pistons to form the multiple layers of seal, and wherein the plurality of pistons, in response to receiving the differential pressure, cause the sealing assembly to expand such that retaining teeth of at least two retainer rings, which are positionable adjacent to a tubing around which the sealing assembly is positionable, contact a retaining mechanism of the tubing to retain the sealing assembly in an expanded state.

2. The sealing assembly of claim 1, wherein the at least one element includes an expandable elastomeric material, and wherein the expandable elastomeric material is characterized by an expansion ratio of between 3% to 50% of an outside diameter of the sealing assembly.

3. The sealing assembly of claim 1, wherein the sealing assembly is a first sealing assembly, wherein the first sealing assembly is included in a plurality of sealing assemblies, each sealing assembly in the plurality of sealing assemblies being identical to the first sealing assembly, and wherein the plurality of sealing assemblies are positionable downhole in the open-hole wellbore to form the multiple layers of seal in a plurality of sections of the open-hole wellbore.

4. The sealing assembly of claim 1, further comprising:

the at least two retainer rings positioned adjacent to the first expandable sealing element and the second expandable sealing element, the at least two retainer rings comprising the retaining teeth positioned on an interior surface of the at least two retainer rings adjacent to the tubing, wherein the tubing comprises the retaining mechanism, and wherein the sealing assembly is positionable around the tubing for being positioned downhole in the open-hole wellbore.

5. The sealing assembly of claim 4, further comprising the plurality of pistons mechanically coupled to the at least two retainer rings.

6. The sealing assembly of claim 5, further comprising:

at least two internal seals adjacent to the at least two retainer rings and to the container housing; and a rigid containing mechanism positioned adjacent to the first expandable sealing element and the second expandable sealing element opposite the at least two retainer rings.

7. The sealing assembly of claim 4, wherein:

the sealing mixture is positionable within the container housing for retaining the sealing mixture before the sealing assembly is expanded;

the multiple layers of seal include a first pressure seal formed by the first expandable sealing element and the second expandable sealing element and a second pressure seal formed by the sealing mixture;

the multiple layers of seal are formable in response to the plurality of pistons receiving the differential pressure and the sealing assembly expanding;

a rigid containing mechanism, in response to the plurality of pistons receiving the differential pressure, contains the first expandable sealing element and the second expandable sealing element and allows the first expandable sealing element and the second expandable sealing element to expand to contact the wall of the open-hole wellbore to form the first pressure seal; and at least two internal seals provide seals within the sealing assembly to prevent the sealing mixture from leaking, and to allow the sealing mixture to form the second pressure seal, after the sealing assembly is expanded.

8. A method comprising:

positioning a sealing assembly downhole in an open-hole wellbore, the sealing assembly comprising (i) at least one element having a first expandable sealing element and a second expandable sealing element and (ii) a container housing positioned between the first expandable sealing element and the second expandable sealing element, the container housing comprising a sealing mixture;

applying differential pressure to a plurality of pistons of the sealing assembly to release the sealing mixture from the container housing (i) to cause the sealing mixture to directly contact a wall of the open-hole wellbore for pressure-sealing the open-hole wellbore and (ii) to form multiple layers of seal between the at least one element and the container housing, wherein the plurality of pistons, in response to receiving the differential pressure, cause the sealing assembly to expand such that retaining teeth of at least two retainer rings, which are positionable adjacent to a tubing around which the sealing assembly is positionable, contact a retaining mechanism of the tubing to retain the sealing assembly in an expanded state; and performing wellbore-related tasks in the pressure-sealed open-hole wellbore.

9. The method of claim 8, wherein the sealing assembly further comprises:

the at least two retainer rings positioned adjacent to the first expandable sealing element and the second expandable sealing element, the at least two retainer rings comprising the retaining teeth positioned on an interior surface of the at least two retainer rings adjacent to the tubing, wherein the tubing comprises the retaining mechanism;

the plurality of pistons mechanically coupled to the at least two retainer rings;

at least two internal seals adjacent to the at least two retainer rings and to the container housing; and a rigid containing mechanism positioned adjacent to the first expandable sealing element and the second expandable sealing element opposite the at least two retainer rings.

10. The method of claim 9, wherein applying differential pressure to the sealing assembly to form multiple layers of seal to pressure seal the open-hole wellbore includes:

forming a first pressure seal by causing the first expandable sealing element or the second expandable sealing element to expand to contact the wall of the open-hole wellbore; and forming a second pressure seal by causing the sealing mixture to be released from the container housing to contact the wall of the open-hole wellbore, wherein:

the differential pressure is received by the plurality of pistons to cause the first expandable sealing element or the second expandable sealing element to expand and to cause the sealing mixture to be released;

the multiple layers of seal include the first pressure seal and the second pressure seal; and the at least two internal seals provide seals within the sealing assembly to prevent the sealing mixture from leaking, and to allow the sealing mixture to form the second pressure seal, after the plurality of pistons receive the applied differential pressure.

11. The method of claim 10 wherein:

the sealing mixture is positioned within the container housing for retaining the sealing mixture before the differential pressure is received by the plurality of pistons; and the rigid containing mechanism, in response to the plurality of pistons receiving the applied differential pressure, contains the first expandable sealing element and the second expandable sealing element and allows the first expandable sealing element and the second expandable sealing element to expand to contact the wall of the open-hole wellbore to form the first pressure seal.

12. A system for forming multiple layers of seal in an open-hole wellbore, the system comprising:

a sealing assembly comprising:

at least one element comprising a first expandable sealing element and a second expandable sealing element;

a sealing mixture; and a container housing positionable between the first expandable sealing element and the second expandable sealing element for retaining the sealing mixture that is releasable, in response to the system being actuated, from the container housing (i) to directly contact a wall of the open-hole wellbore for pressure sealing the open-hole wellbore between the at least one element and the container housing and (ii) for providing multiple layers of seal, wherein differential pressure is receivable by a plurality of pistons to form the multiple layers of seal, and wherein the plurality of pistons, in response to receiving the differential pressure, cause the sealing assembly to expand such that retaining teeth of at least two retainer rings, which are positionable adjacent to a tubing around which the sealing assembly is positionable, contact a retaining mechanism of the tubing to retain the system in an expanded state; and the tubing comprising the retaining mechanism for retaining the system after the system expands.

13. The system of claim 12, wherein the at least one element includes an expandable elastomeric material, and wherein the expandable elastomeric material is characterized by an expansion ratio of between 3% and 50% of an outside diameter of the system.

14. The system of claim 12, further comprising:

the at least two retainer rings positioned adjacent to the first expandable sealing element and the second expandable sealing element, the at least two retainer rings comprising the retaining teeth positioned on an interior surface of the at least two retainer rings adjacent to the tubing;

the plurality of pistons mechanically coupled to the at least two retainer rings;

at least two internal seals adjacent to the at least two retainer rings and to the container housing; and a rigid containing mechanism positioned adjacent to the first expandable sealing element and the second expandable sealing element opposite the at least two retainer rings.

15. The system of claim 14, wherein:

the sealing mixture is positionable within the container housing before the system is expanded;

the multiple layers of seal include a first pressure seal formed by the first expandable sealing element and the second expandable sealing element and a second pressure seal formed by the sealing mixture;

the rigid containing mechanism, in response to the plurality of pistons receiving the differential pressure, contains the first expandable sealing element and the second expandable sealing element and allows the first expandable sealing element and the second expandable sealing element to expand to contact the wall of the open-hole wellbore to form the first pressure seal;

the at least two internal seals provide seals within the system to prevent the sealing mixture from leaking, and to allow the sealing mixture to form the second pressure seal, after the system is expanded; and the multiple layers of seal are formable in response to the plurality of pistons receiving the differential pressure and the system expanding.

* * * * *